United States Patent [19]

Werley

[11] Patent Number: 4,566,284

[45] Date of Patent: Jan. 28, 1986

[54] METHOD AND APPARATUS TO UPGRADE THE CAPACITY OF AMBIENT-AIR LIQUID CRYOGEN VAPORIZERS

[75] Inventor: Barry L. Werley, Allentown, Pa.

[73] Assignee: Air Products and Chemicals, Inc., Allentown, Pa.

[21] Appl. No.: 715,430

[22] Filed: Mar. 25, 1985

[51] Int. Cl.[4] ..... F17C 7/02

[52] U.S. Cl. ..... 62/52; 165/179; 165/183

[58] Field of Search ..... 62/52; 165/179, 183

[56] References Cited

U.S. PATENT DOCUMENTS 3,735,465 5/1973 Tibbetts et al. ..... 62/52
4,226,605 10/1980 Van Don ..... 62/52
4,399,660 8/1983 Volger, Jr. et al. ..... 62/52
4,479,359 10/1984 Pelloux-Gervais ..... 62/52
4,487,256 12/1984 Lutjens et al. ..... 62/52

*Primary Examiner*—Ronald C. Capossela
*Attorney, Agent, or Firm*—Mark L. Rodgers; E. Eugene Innis; James C. Simmons

[57] ABSTRACT

The present invention is an improved ambient-air liquid cryogen vaporizer and a method of using the same. The interconnections between the vertical starfinned pipe lengths of the vaporizer are arranged such that the coldest temperature pipe lengths are placed at more remote locations from the warmer pipe lengths than in previous vaporizer set-ups. This arrangement increases the capacity of the vaporizer by reducing ice bridging between the colder and warmer fins.

5 Claims, 3 Drawing Figures

FIG. 1
PRIOR ART
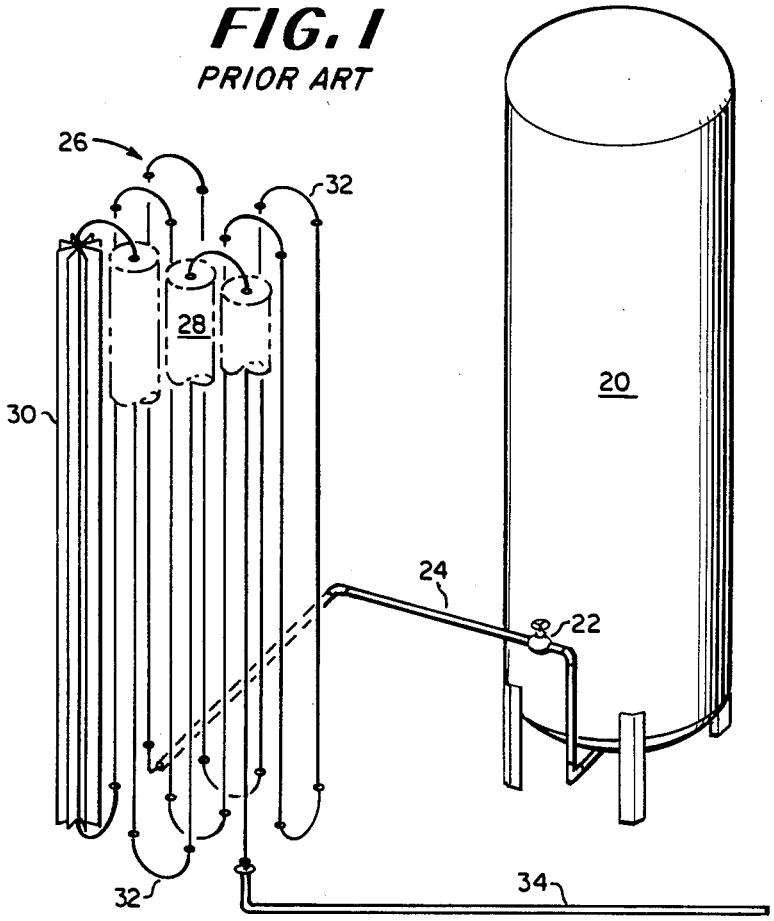
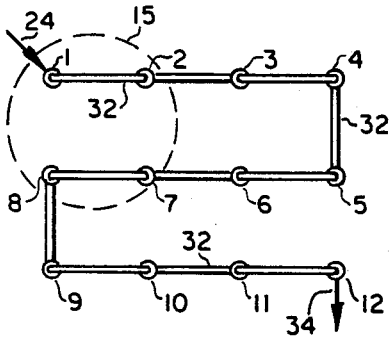
FIG. 2
PRIOR ART
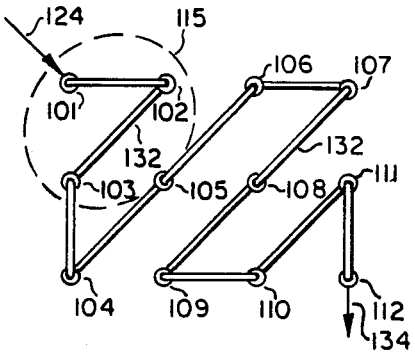
FIG. 3

METHOD AND APPARATUS TO UPGRADE THE CAPACITY OF AMBIENT-AIR LIQUID CRYOGEN VAPORIZERS

TECHNICAL FIELD OF THE INVENTION

The present invention relates to the vaporization of cryogenic liquids by passing said cryogenic liquid through a vaporizer in heat exchange with ambient air. More particularly, it relates to the vaporizer design and the path of flow of the cryogenic fluid through the vaporizer.

BACKGROUND OF THE INVENTION

Ambient-air vaporizers are used to vaporize cryogenic liquids before being piped to downstream operations or being released to the surrounding atmosphere. Such vaporizers are typically of the Starfin-type and have longitudinally finned pipe lengths arranged in a 3×4 rectangular array. A side view of such a vaporizer is shown in FIG. 1 labeled prior art, and a top view is shown in FIG. 2, also labeled prior art.

The liquid to be vaporized enters the fin section Labeled 1 and is passed through the fin pipings in numerical order as depicted in FIG. 2 until it exits from fin pipe 12. The liquid enters the bottom of the first finned pipe, passes through, exits the top and subsequently enters the top of the next pipe where it flows to the bottom, exits, and enters the bottom of the next pipe, etc.

If gas delivery temperature from the vaporizer falls below a preset value, a low temperature shut off valve closes to prevent liquid carry-over to the customer or embrittlement of downstream piping caused by extreme cold temperatures. For example, if carbon-steel piping is used to transport the gas downstream of the vaporizer, a shut off temperature of about −23° C. is employed to prevent embrittlement of the piping. In extremely cold weather conditions and/or high product flow, the vaporizers can develop ice formations and freeze-over between the fins occurs. When such a freeze-over occurs, the capacity of the vaporizer decreases, and can thereby cause the gas delivery temperature to fall below such a preset value. This decrease in capacity is due in part to reduced convective heat transfer and ice bridging between fin pipings which allows conduction between warmer fins and colder fins. When such a decrease in capacity occurs it is necessary to physically chop away the ice which is formed between the fin pipings of the vaporizer in order to get the system back on-stream following a shutdown.

Solutions to the problem of reduced capacity due to reduced heat transfer and ice bridging between the fins have included installing low temperature-ductile metal systems downstream which tolerate lower delivery gas temperatures or installing heated vaporizers which use steam or electric heat to vaporize the cryogenic liquid. Additionally, it has been suggested to increase the number of ambient vaporizers in series or parallel connected pairs, thereby enlarging the vaporizing system itself. All of the above solutions require a considerable increase in equipment and process cost.

BRIEF SUMMARY OF THE INVENTION

The present invention provides for an improved ambient-air liquid cryogen vaporizer and a process for using the same. The invention comprises a new piping arrangement for a typical ambient-air vaporizer having at least twelve vertically disposed pipe lengths arranged in a 3×4 rectangular array with adjacent pipe lengths being approximately equally spaced from one another.

This new piping arrangement is designed such that warmer downstream pipe lengths are placed at more remote locations from colder upstream pipe lengths, thereby reducing ice-bridging with the warmer fins. Consequently, the heat transfer capacity of the vaporizer is increased resulting in a more efficient vaporization process and reducing shutdown time due to cold gas delivery temperatures.

BRIEF DESCRIPTION OF THE DRAWINGS

FIG. 1 is a partial cut-away side view of a typical prior art vaporizer arrangement.

FIG. 2 is a top view of the prior art vaporizer depicted in FIG. 1.

FIG. 3 is a top view of the vaporizer arrangement of the present invention.

DETAILED DESCRIPTION OF THE INVENTION

Ambient-air vaporizers are commonly used to vaporize cryogenic liquids prior to releasing the fluid to the atmosphere or piping to a downstream operation. A typical vaporizer set-up is shown in FIG. 1. A storage vessel or tank 20 containing a cryogenic liquid is connected by a transport pipe 24 to a vaporizer unit 26. A valve 22 is used to regulate the flow of cryogenic liquid to the vaporizer 26. The cryogenic liquid is vaporized in the vaporizer 26 and is subsequently withdrawn through line 34.

A typical ambient-air vaporizer as shown in FIG. 1 has at least 12 vertically disposed pipe lengths 28 having longitudinally placed heat exchange surfaces or starfins 30 with adjacent pipe lengths being approximately equally spaced from one another in a generally rectangular array. One side of the rectangular array has four pipe lengths and the adjacent side has three pipe lengths. The vertical pipe lengths are interconnected alternately top to top and bottom to bottom via "U" shaped connecting pipes 32.

The cryogenic fluid enters and passes through a first pipe length 28 and is subsequently withdrawn and passed through the "U" shaped connecting pipe or conduit 32 into a second vertical pipe length 28. The cryogenic fluid is vaporized at some point in the vaporizer, this point depending upon conditions such as temperature and flow rate. The cryogenic fluid leaving the vaporizer is preferably all vapor and can be vented to the atmosphere if desired.

Typical starfin ambient-air vaporizers are manufactured as standard units with sequential series piping as shown in FIG. 2. In this type of prior art set-up the cryogenic fluid to be vaporized is passed through the 12 pipe lengths in sequential order beginning with the pipe length labeled 1. The cryogenic fluid to be vaporized is passed through each vertical pipe length in numerical order via said "U" shaped connecting pipes or conduits 32.

Operating an ambient-air vaporizer having the prior art pipe placement geometry and interconnection scheme as shown in FIG. 2, often results in ice accumulation on the upstream heating tubes which can extend to obstruct air flow over adjacent tubes which are substantially further downstream in the array and thereby detract from the heat transfer in the warm zone. For example, even in warm whether, a large solid ice block can form between pipes 1, 2, 7 and 8, as depicted by the broken circle 15 in FIG. 2. This ice block represents a thermal short-circuit between the coldest pipe length #1 and pipe length #8 which is two-thirds of the way through the vaporizer. During periods of high flow and/or cold weather, the ice build-up may extend to pipe lengths 9 and 10.

The present invention provides an ambient-air vaporizer piping geometry which lessens the effect of ice build-up on reducing heat transfer in the vaporizer. In this new arrangement, any ice which forms between fins provides conductive paths between fins of more nearly equivalent temperature than in existing designs. As a result, there is less conductive heat transfer and less compromise of vaporizer performance.

The present improved vaporizer configuration and method of using the same can be best understood by reference to FIG. 3. This figure is a top view of an ambient-air vaporizer having 12 vertically disposed pipe lengths with adjacent pipe lengths being approximately equally spaced from one another and being arranged in a 3×4 rectangular array. The 12 pipe lengths have longitudinally placed heat exchange surfaces or starfins.

A cryogenic fluid, partially or completely in the liquid phase, enters a fluid inlet at one end of vertical pipe length 101 via transport pipe 124. The cryogenic fluid passes through pipe length 101 and exits a fluid outlet at the opposite end of the pipe length. The cryogenic fluid then enters a fluid inlet at one end of vertical pipe length 102 located next to the first pipe length 101 via a "U" shaped connecting pipe or conduit 132. All the vertical pipe lengths have fluid inlets and outlets with the fluid inlets being connected via "U" shaped connecting pipes or conduits to the fluid outlets to the preceding vertical pipe lengths. The cryogenic fluid flows through pipe length 102 and exits a fluid outlet at the opposite end of the pipe length. The cryogenic fluid enters a fluid inlet at one end of vertical pipe length 103 located diagonal to the second pipe length 102 and next to the first pipe length 101. The cryogenic fluid passes through vertical pipe length 103 and subsequently is introduced to, and passes through, a fourth vertical pipe length 104 located at a corner of the rectangular array and next to the third pipe length 103. The fluid is removed from the fourth pipe length 104 and passed through a fifth vertical pipe length 105 located diagonal to the fourth pipe length 104 and beside both the second 102 and third 103 pipe lengths. The fluid is then removed from the fifth pipe length 105 and passed through a sixth vertical pipe length 106 located diagonal to the fifth pipe length 105 and beside the second pipe length 102. The fluid is then removed from the sixth vertical pipe length 106 and passed through a seventh vertical pipe length 107 located at a corner of the rectangle and beside said sixth pipe length 106. The fluid is subsequently removed from the seventh pipe length 107 and passed through an eighth vertical pipe length 108 located diagonal to the seventh vertical pipe length 107 and beside said fifth 105 and sixth 106 pipe lengths. The fluid is then removed from the eighth vertical pipe length 108 and passed through a ninth vertical pipe length 109 located diagonal to the eighth pipe length 108 and beside said fourth 104 and fifth 105 pipe lengths. The fluid is removed from the ninth vertical pipe length 109 and passed through a tenth vertical pipe length 110 located beside the eighth pipe length 108 and ninth pipe length 109. Further, the fluid is removed from the tenth vertical pipe length 110 and passed to an eleventh vertical pipe length 111 located diagonal to the tenth pipe length 110 and beside the seventh 107 and eighth 108 pipe lengths. Finally, the fluid is removed from the eleventh vertical pipe length 111 and passed through a twelfth vertical pipe length 112 located at the remaining corner of the rectangle and beside the tenth 110 and eleventh 111 pipe lengths. After passing through the twelfth vertical pipe length 112 the fluid is at least partially, and preferably totally, vaporized and is subsequently withdrawn via exit pipe 134.

While the above description illustrates a vaporization process in accordance with FIG. 3 wherein the cryogenic fluid is passed through the pipe lengths of the vaporizer in numerical order starting with pipe length 101 and ending with pipe length 112, the flow of the fluid through the vaporizer could easily be reversed; i.e. the fluid entering the pipe length 112, proceeding through the pipe lengths in numerical order and exiting pipe length 101.

The present process and apparatus can be used to treat any cryogenic fluid which is typically partially or completely in the liquid state and which normally exists as a vapor under ambient conditions. Examples of such cryogenic fluids are liquid oxygen, liquid nitrogen, and liquid argon. The present apparatus can also be employed as a heat exchange device for any gas or liquid having a temperature different from that of the surrounding air.

As can be seen in FIG. 3, a same size ice block, as depicted by broken circle 115, as that in FIG. 2, only establishes bridging between pipe lengths 101, 102, 103, and 105, which are much colder than pipe lengths 7 and 8 in FIG. 2. In other words, in the prior art technology the inlet pipe length 1 might heat exchange against a fin of a pipe length 67% of the way through the vaporizer; i.e. pipe length 8 in FIG. 2; whereas in the present invention the inlet pipe length 101 will heat exchange a fin only 25% of the way through the exchanger, i.e. pipe length 103.

This improved configuration of vaporizer piping allows for a more efficient heat exchange to occur within the vaporizer resulting in less shutdown time due to freeze over and cold outlet fluid temperatures. If the cryogenic fluid exiting the last pipe length in the vaporizer is not completely vaporized, or is too cold for subsequent use, additional vaporizer units may be added in series or in parallel.

Having thus described the present invention, what is now deemed appropriate for Letters Patent is set out in the following appended claims.

What is claimed:

1. In a process for vaporizing a cryogenic fluid in an ambient-air vaporizer having at least twelve vertically disposed pipe lengths containing longitudinally placed heat exchange fins, said adjacent pipe lengths being approximately equally spaced from one another in a generally rectangular array with one side of the rectangle having four pipe lengths and the adjacent side having three pipe lengths, the improvement for upgrading the capacity of the vaporizer by minimizing ice build-up near the warmer pipe lengths which comprises:

(a) initially passing the cryogenic fluid to be vaporized through a first vertical pipe length located at one corner of the rectangle;

(b) removing the fluid from the first vertical pipe length and passing it through a second vertical pipe length located next to the first pipe length;

(c) removing the fluid from the second vertical pipe length and passing it through a third vertical pipe length located diagonal to the second pipe length and next to the first pipe length;

(d) removing said fluid from the third vertical pipe length and passing it through a fourth vertical pipe length located beside the third pipe length, and farthest from the first pipe length;

(e) removing the fluid from the fourth vertical pipe length and passing it through a fifth vertical pipe length located diagonal to the fourth pipe length and beside both the second and third pipe lengths;

(f) removing said fluid from the fifth vertical pipe length and passing it through a sixth vertical pipe length located diagonal to the fifth pipe length and beside the second pipe length;

(g) removing said fluid from the sixth vertical pipe length and passing it through a seventh vertical pipe length located beside said sixth pipe length;

(h) removing said fluid from the seventh vertical pipe length and passing it through an eighth vertical pipe length located diagonal to the seventh vertical pipe length and beside said fifth pipe length;

(i) removing said fluid from the eighth vertical pipe length and passing it through a ninth vertical pipe length located diagonal to the eighth pipe length and beside said fourth pipe length;

(j) removing said fluid from the ninth vertical pipe length and passing it through a tenth vertical pipe length located beside the eighth and ninth pipe lengths;

(k) removing said fluid from the tenth vertical pipe length and passing it through an eleventh vertical pipe length located diagonal to the tenth pipe length and beside the seventh and eighth pipe lengths;

(l) removing said fluid from the eleventh vertical pipe length and passing it through a twelfth vertical pipe length located at a corner of the rectangle beside the tenth and eleventh pipe lengths; and (m) removing said vaporized fluid from said twelfth vertical pipe length.

2. The process in accordance with claim 1 wherein the cryogenic fluid to be vaporized is liquid nitrogen.

3. The process in accordance with claim 1 wherein the cryogenic fluid to be vaporized is liquid oxygen.

4. The process in accordance with claim 1 wherein the cryogenic fluid to be vaporized is liquid argon.

5. In an apparatus for vaporizing a cryogenic liquid, said apparatus having at least 12 vertically disposed pipe lengths containing longitudinally placed heat exchange fins, said adjacent pipe lengths being approximately equally spaced from one another in a generally rectangular array with one side of the rectangle having four pipe lengths and the adjacent side having three pipe lengths, the improvement for upgrading the capacity of the vaporizer by minimizing ice build-up near the warmer pipe lengths which comprises:

(a) a first vertical pipe length located at one corner of the rectangle, having a fluid inlet at one end and a fluid outlet at the other end, said fluid outlet being connected via a conduit to a fluid inlet of a second pipe length located next to the first pipe length;

(b) said second vertical pipe length having a fluid outlet connected via a conduit to a fluid inlet of a third vertical pipe length located diagonal to the second pipe length and next to the first pipe length;

(c) said third vertical pipe length having a fluid outlet connected via a conduit to a fluid inlet of a fourth vertical pipe length beside the third pipe length, and farthest from the first pipe length;

(d) said fourth vertical pipe length having a fluid outlet connected via a conduit to a fluid inlet of a fifth vertical pipe length located diagonal to the fourth pipe length and beside both the second and third pipe lengths;

(e) said fifth vertical pipe length having a fluid outlet connected via a conduit to a fluid inlet of a sixth vertical pipe length located diagonal to the fifth pipe length and beside the second pipe length;

(f) said sixth vertical pipe length having a fluid outlet connected via a conduit to a fluid inlet of a seventh vertical pipe length located beside said sixth pipe length;

(g) said seventh vertical pipe length having a fluid outlet connected via a conduit to a fluid inlet of an eighth vertical pipe length located diagonal to the seventh vertical pipe length and beside said fifth pipe length;

(h) said eighth vertical pipe length having a fluid outlet connected via a conduit to a fluid inlet of a ninth vertical pipe length located diagonal to the eighth pipe length and beside said fourth pipe length;

(i) said ninth vertical pipe length having a fluid outlet connected via a conduit to a fluid inlet of a tenth vertical pipe length located beside the eighth and ninth pipe lengths;

(j) said tenth vertical pipe length having a fluid outlet connected via a conduit to a fluid inlet of an eleventh vertical pipe length located diagonal to the tenth pipe length and beside the seventh and eighth pipe lengths;

(k) said eleventh vertical pipe length having a fluid outlet connected via a conduit to a fluid inlet of a twelfth vertical pipe length located at a corner of the rectangle beside the tenth and eleventh pipe lengths; and (l) said twelfth vertical pipe length having a fluid outlet on the opposite end of the pipe length from the fluid inlet for removing the vaporized cryogenic fluid.

* * * * *